US008567485B2

(12) United States Patent
Viklund et al.

(10) Patent No.: US 8,567,485 B2
(45) Date of Patent: Oct. 29, 2013

(54) HEAT EXCHANGER FOR CONNECTION TO AN EVAPORATOR OF A HEAT TRANSFER SYSTEM

(75) Inventors: Bengt Ake Viklund, Grasturp (SE); Gote Gunnar Berggren, Lidkuping (SE); Leo Ostergaard Mogensen, Engesvang (DK)

(73) Assignee: TI Group Automotive Systems Limited, Oxford (GB)

( * ) Notice: Subject to any disclaimer, the term of this patent is extended or adjusted under 35 U.S.C. 154(b) by 1698 days.

(21) Appl. No.: 11/575,930

(22) PCT Filed: Sep. 23, 2005

(86) PCT No.: PCT/GB2005/003700

§ 371 (c)(1),
(2), (4) Date: Mar. 23, 2007

(87) PCT Pub. No.: WO2006/032922

PCT Pub. Date: Mar. 30, 2006

(65) Prior Publication Data

US 2007/0215333 A1 Sep. 20, 2007

(30) Foreign Application Priority Data

Sep. 24, 2004 (GB) ..... 0421274.2

(51) Int. Cl.
*F28D 7/02* (2006.01)

(52) U.S. Cl.
USPC ..... 165/164; 165/142; 62/511; 29/890.035

(58) Field of Classification Search
USPC ..... 165/49, 142, 164, 165, 168, 185; 62/511; 29/890.035
See application file for complete search history.

(56) References Cited

U.S. PATENT DOCUMENTS

| | | | | | |
|---|---|---|---|---|---|
| 1,890,784 | A | * | 12/1932 | Jacobus | 122/478 |
| 2,133,961 | A | * | 10/1938 | Buchanan | 62/113 |
| 2,220,595 | A | * | 11/1940 | Andersen | 62/525 |
| 2,415,243 | A | * | 2/1947 | Hickman | 62/527 |
| 2,434,118 | A | * | 1/1948 | Newman | 62/511 |
| 2,521,040 | A | * | 9/1950 | Casetta | 62/509 |
| 2,590,731 | A | * | 3/1952 | Shawhan | 62/296 |
| 2,687,626 | A | * | 8/1954 | Bartlowe | 62/276 |
| 2,705,874 | A | * | 4/1955 | Binder et al. | 62/234 |
| 2,776,550 | A | * | 1/1957 | Magester | 62/527 |
| 2,776,552 | A | * | 1/1957 | Thomas | 62/513 |

(Continued)

FOREIGN PATENT DOCUMENTS

| | | | |
|---|---|---|---|
| DE | 973 828 | C | 6/1960 |
| FR | 2528157 | A | 12/1983 |

(Continued)

*Primary Examiner* — Ljiljana Ciric
(74) *Attorney, Agent, or Firm* — Leydig, Voit & Mayer, Ltd.

(57) ABSTRACT

A heat transfer system having an evaporator, a heat exchanger, and a working fluid that undergoes compression. The heat exchanger includes a first tube made from a steel alloy which is alloyed to facilitate bending, the first tube having a first end connected to the outlet of an evaporator and a second tube having a first end connected to the inlet of the evaporator. The second tube is positioned in thermal contact with the first tube for a portion of the respective lengths of the first tube and the second tube, so as to allow an exchange of heat between the fluid within the tubes.

21 Claims, 9 Drawing Sheets

(56) References Cited

U.S. PATENT DOCUMENTS

| | | | | | |
|---|---|---|---|---|---|
| 2,877,630 | A | * | 3/1959 | Schultz | 62/276 |
| 2,956,421 | A | * | 10/1960 | Stevens | 62/511 |
| 2,959,027 | A | * | 11/1960 | Ewing | 62/160 |
| 2,979,924 | A | * | 4/1961 | Balogh | 62/511 |
| 3,048,021 | A | * | 8/1962 | Frame et al. | 62/51.2 |
| 3,145,545 | A | * | 8/1964 | Jaeger | 62/323.4 |
| 3,172,272 | A | * | 3/1965 | Alsing | 62/324.6 |
| 3,531,947 | A | * | 10/1970 | Drury et al. | 62/511 |
| 3,566,615 | A | * | 3/1971 | Roeder, Jr. | 62/511 |
| 3,820,571 | A | * | 6/1974 | Grier | 138/44 |
| RE29,332 | E | * | 8/1977 | Bilbro et al. | 165/185 |
| 4,086,782 | A | * | 5/1978 | Forsberg | 62/296 |
| 4,087,987 | A | * | 5/1978 | Schumacher et al. | 62/276 |
| 4,120,284 | A | * | 10/1978 | Cotsworth et al. | 165/49 |
| 4,147,037 | A | * | 4/1979 | Gelbard et al. | 62/113 |
| 4,150,558 | A | * | 4/1979 | Pohl | 29/890.035 |
| 4,184,342 | A | * | 1/1980 | Pohl | 62/511 |
| 4,304,099 | A | * | 12/1981 | Vakil | 62/86 |
| 4,333,669 | A | * | 6/1982 | Eckert | 285/21.1 |
| 4,347,433 | A | * | 8/1982 | Wojtecki et al. | 165/183 |
| 4,395,882 | A | * | 8/1983 | Kast et al. | 60/527 |
| 4,408,467 | A | * | 10/1983 | Murnane et al. | 62/296 |
| 4,497,363 | A | * | 2/1985 | Heronemus | 165/165 |
| 4,793,150 | A | * | 12/1988 | Wattley et al. | 62/296 |
| 4,955,210 | A | * | 9/1990 | Hansen | 62/511 |
| 5,238,557 | A | * | 8/1993 | Schneider et al. | 165/164 |
| 5,269,158 | A | * | 12/1993 | Bitter et al. | 62/511 |
| 5,345,780 | A | * | 9/1994 | Aaron et al. | 62/324.6 |
| 5,533,362 | A | | 7/1996 | Cook et al. | |
| 5,749,242 | A | * | 5/1998 | Mowery | 165/142 |
| 5,765,384 | A | * | 6/1998 | Carlstedt et al. | 62/276 |
| 5,797,277 | A | * | 8/1998 | Hong et al. | 62/285 |
| 5,890,375 | A | | 4/1999 | Stahl et al. | |
| 6,170,289 | B1 | * | 1/2001 | Brown et al. | 62/511 |
| 6,212,891 | B1 | | 4/2001 | Minta et al. | |
| 6,273,427 | B1 | * | 8/2001 | Simmons et al. | 138/89 |
| 6,305,188 | B1 | * | 10/2001 | Park | 62/513 |
| 7,021,372 | B2 | * | 4/2006 | Pickard | 165/168 |
| 7,243,499 | B2 | * | 7/2007 | Cole et al. | 62/77 |
| 7,430,874 | B2 | * | 10/2008 | Prince et al. | 62/199 |
| 7,438,123 | B2 | * | 10/2008 | Tadokoro | 165/164 |
| 7,604,240 | B2 | * | 10/2009 | Arthur | 277/316 |
| 7,861,553 | B2 | * | 1/2011 | Ryoo | 62/513 |
| 2005/0109486 | A1 | * | 5/2005 | Memory et al. | 165/62 |

FOREIGN PATENT DOCUMENTS

| | | | |
|---|---|---|---|
| FR | 2631688 | A3 | 11/1989 |
| GB | 728 131 | A | 4/1955 |
| GB | 1031989 | A | 6/1966 |
| GB | 1 130 038 | A | 10/1968 |
| GB | 1 226 241 | A | 3/1971 |
| GB | 1 291 748 | A | 10/1972 |
| GB | 2 046 890 | A | 11/1980 |
| GB | 2 133 524 | A | 7/1984 |

* cited by examiner

| | RANGE OF ALLOY CONTENT BY MASS | TYPICAL ALLOY CONTENT BY MASS |
|---|---|---|
| CARBON | 0.001% - 0.02% | 0.02% |
| MANGANESE | 0.10% - 0.25% | 0.25% |
| PHOSPHORUS | 0.00% - 0.02% | 0.02% |
| SULPHUR | 0.01% - 0.02% | 0.02% |
| TITANIUM | 0.06 - 0.3% | 0.3% |

*Figure 9*

| | Copper tube | Conventional steel tube | Annealed low carbon steel tube |
|---|---|---|---|
| Diameter (mm) | 6 | 6 | 6 |
| Wall thickness (mm) | 0.65 | 0.70 | 0.70 |
| Relative force | 1.0 | 2.8 | 1.85 |

*Figure 10*

HEAT EXCHANGER FOR CONNECTION TO AN EVAPORATOR OF A HEAT TRANSFER SYSTEM

This application is the U.S. national phase of International Patent Application PCT/GB2005/003700, filed on Sep. 23, 2005, which claims priority to G.B. Patent Application No. 0421274.2, filed Sep. 24, 2004, all of which are hereby incorporated by reference.

BACKGROUND OF THE INVENTION

The present invention relates to heat exchanger for connection to an evaporator of a heat transfer system, a heat transfer system including a heat exchanger connected to an evaporator, a method of manufacturing a heat exchanger, and a tube for use in a heat transfer system.

In domestic refrigerators and freezers, it is usual to have a capillary tube which transmits liquid refrigerant to an evaporator, and a copper suction tube which transmits gaseous refrigerant from the evaporator. It is also known to arrange a portion of the length of the capillary tube and suction tube together to form a heat exchanger. Consequently, refrigerant fluid transmitted from the evaporator is warmed by the fluid transmitted to the evaporator, and similarly fluid transmitted to the evaporator is cooled by the fluid returned from the evaporator.

A problem with such an arrangement is the high cost of the copper used to form the suction tube.

BRIEF SUMMARY OF THE INVENTION

According to a first aspect of the present invention, there is provided, a heat exchanger for connection to an evaporator of a heat transfer system using a working fluid that undergoes compression and evaporation, said heat exchanger comprising a first tube having a first end configured to be connected to an outlet of an evaporator to allow fluid transmission from said outlet; and a second tube having a first end configured to be connected to an inlet of the evaporator to allow fluid transmission to said inlet, wherein said second tube is positioned within, or in thermal contact with, said first tube for a proportion of the respective lengths of said first tube and said second tube to allow an exchange of heat between the fluid within said tubes, said first tube is constructed from steel alloy; and said steel alloy has alloyed components which reduce the hardness of said steel to facilitate tube bending, thereby allowing said first tube to be bent during installation within the heat transfer system.

According to a second aspect of the present invention, there is provided a heat exchanger comprising a capillary tube for transporting a liquid to an evaporator of a heat transfer system, and a suction tube for transporting fluid from the evaporator, wherein a portion of the length of the capillary tube is secured to a portion of the length of the suction tube such that thermal conduction is provided from the liquid in the capillary tube to the fluid in the suction tube, and wherein the suction tube comprises a steel alloy tube, and at least said portion of the steel alloy tube is coated with a protective coating providing a surface onto which the capillary tube is soldered or brazed.

According to a third aspect of the present invention, there is provided a tube for use in a heat transfer system comprising a steel alloy in which the percentage content by mass of carbon is less than 0.03% and that of titanium is between 0.05% and 0.4%.

BRIEF DESCRIPTION OF THE SEVERAL VIEWS OF THE DRAWINGS

FIG. 9 shows a table of the alloyed elements of the steel alloy from which the suction tube is made; and FIG. 10 shows parameters of tubes used in a bending experiment and the relative forces required to cause the tubes to plastically bend.

WRITTEN DESCRIPTION OF THE BEST MODE FOR CARRYING OUT THE INVENTION

FIG. 1

Figure 1:
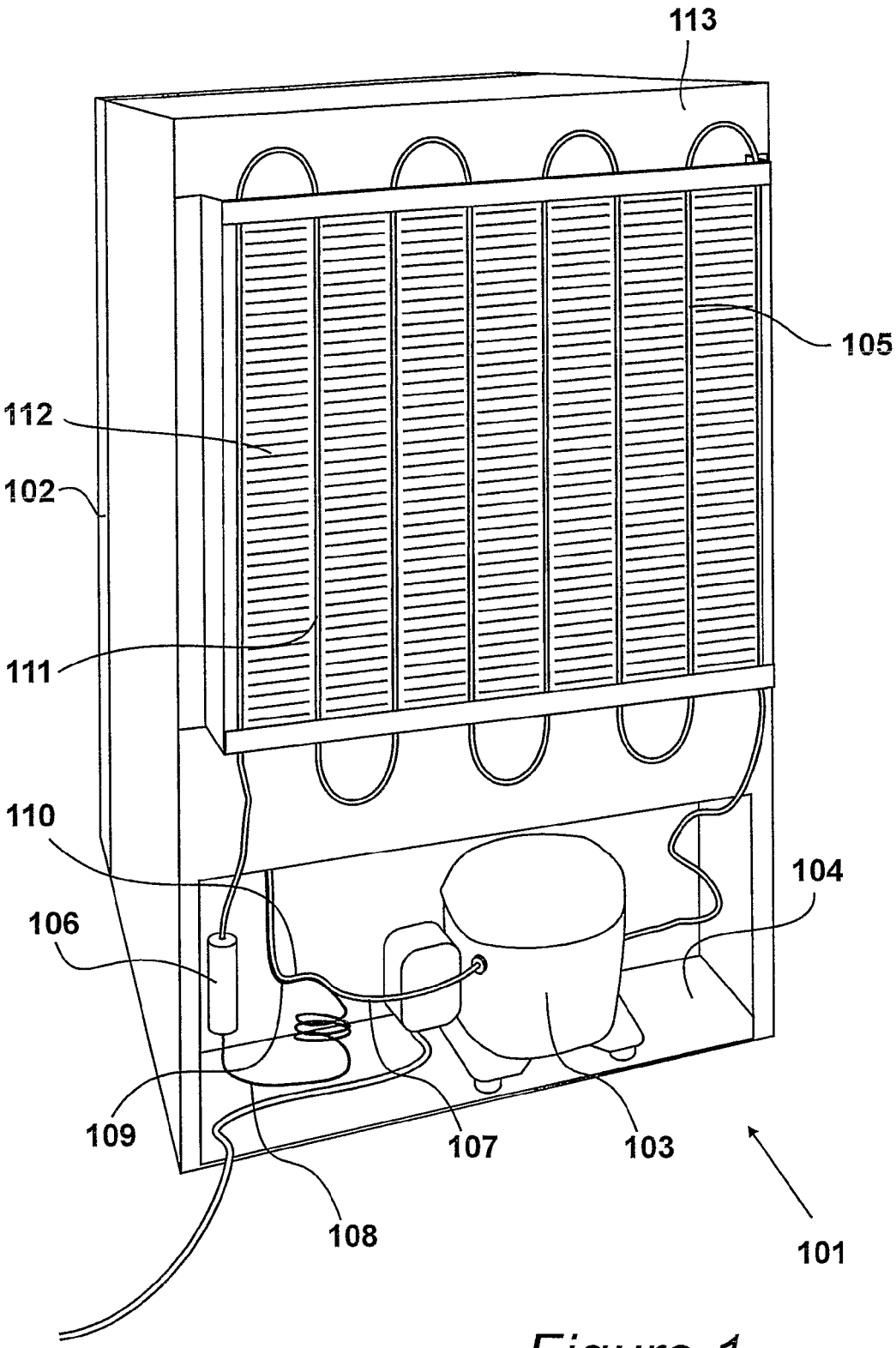
FIG. 1 shows a rear perspective view of a domestic refrigeration unit 101.

A rear perspective view of a domestic refrigeration unit 101 is shown in FIG. 1. In the present example, the refrigeration unit is a refrigerator having a door 102 at its front to allow access to a refrigeration cavity. The cavity is configured to provide cold storage for perishable goods such as food, drinks, etc.

The refrigerator 101 has a heat transfer system which pumps heat from the refrigeration cavity to the air surrounding the refrigerator. The heat transfer system comprises an electrically powered compressor 103 located within a lower rear compartment 104 of the refrigerator, a condenser 105 mounted on a rear outer wall 113 of the refrigerator, a drying and filtering unit 106, and an evaporator (shown as 201 in FIG. 2) mounted within the refrigeration cavity.

The condenser 105 comprises a meandering tube 111 attached to a louvered panel 112 which assists transportation of heat from the tube 111 to the surrounding air during operation.

In addition, the heat transfer system comprises: a suction tube 107 which has a first end connected to the outlet of the evaporator and a second end connected to the inlet of the compressor 103; and a capillary tube 108 which has a first end connected to the outlet of the condenser 105 via the dryer and filtering unit 106 and a second end connected to the inlet of the evaporator.

A middle portion 109 of the length the capillary tube 108 is secured to a middle portion 110 of the length of the suction tube 107, while each of the tubes 107 and 108 have free portions adjacent their ends to allow relevant connections to other components of the heat transfer system.

During the production of the refrigeration unit 101, the suction tube 107, has its first end connected to the evaporator. Its second end is then passed through holes in rear walls of the refrigeration unit and then connected to the compressor 103. This process requires a degree of manual manipulation and bending of the suction tube 107. Conventionally, the suction tube has been made from copper which allows such manipulation and bending to be manually performed. However, the present suction tube is made from a steel material which has also been found to provide the necessary softness to facilitate these manual operations.

FIG. 2

Figure 2:
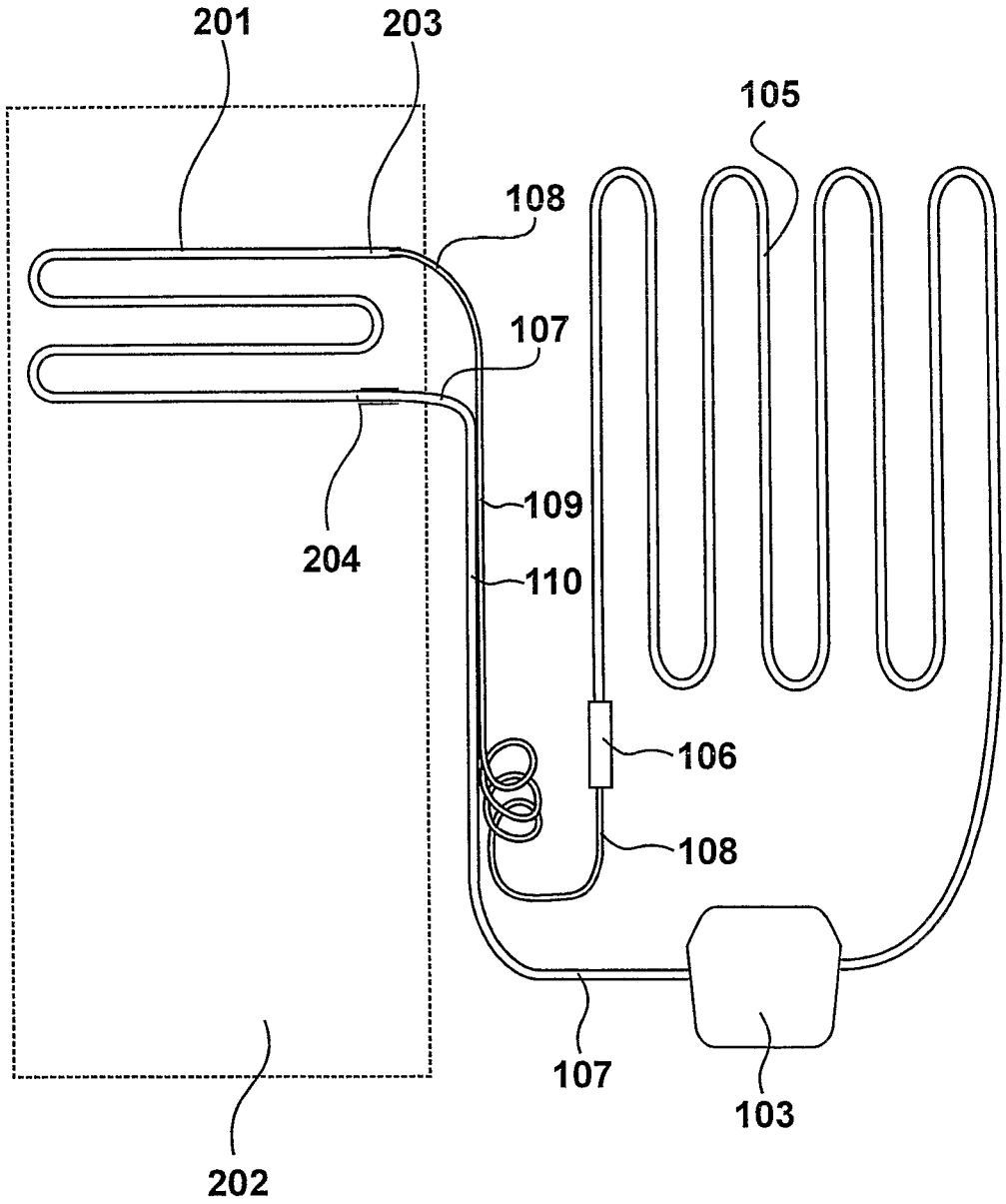
FIG. 2 shows schematically the heat transfer system of the refrigerator 101.

The heat transfer system of the refrigerator 101 is shown schematically in FIG. 2. In addition to the compressor 103, condenser 105, dryer and filter unit 106, capillary tube 108 and suction tube 107, FIG. 2 also shows the evaporator 201 located within the refrigeration cavity 202.

The evaporator 201 comprises a meandering tube which has an inlet 203 connected to the capillary tube 108 and a separate outlet 204 connected to the suction tube 107. Typically, the evaporator tube will be mounted on a plate which assists the transfer of heat from the air within the refrigeration cavity 202 to the evaporator tube. Alternatively, the evaporator tube may take the form of deformations in a pair of connected plates, formed in a roll bond process as is known in the art.

The heat transfer system contains a refrigerant fluid that is a gas at ambient pressure and temperature but is capable of being liquefied under pressure. During operation, the compressor 103 pumps the refrigerant around a circuit comprising the condenser 105, the drying and filtering unit 106, the capillary tube 108, the evaporator 201, and the suction tube 107, in that order. The capillary tube 108 has an internal diameter, typically of 0.7 millimeters, that is small when compared with the internal diameters of the tubes of the condenser 105 and the evaporator 201. Consequently, the capillary tube acts as a resistance to flow of refrigerant and during operation of the compressor it allows pressure to build up in the condenser 105.

During operation, the compressor 103 pumps very warm gaseous refrigerant (typically at 70 degrees centigrade) into the condenser 105. As the refrigerant travels through the condenser 105 it loses heat to the surrounding air until its temperature becomes so low that it condenses to form a liquid (typically at around 35 degrees centigrade.) Thus, by the time the refrigerant reaches the capillary tube it is in the form of a warm liquid.

Consequently, liquid refrigerant is transported into the evaporator, where the pressure is comparatively low, and it evaporates into a gas again. The process of evaporation requires the absorption of the latent heat of evaporation of the refrigerant and thus it has a cooling effect on the evaporator and the refrigeration cavity.

The gaseous refrigerant then passes through the suction tube 107 back to the compressor 103.

As mentioned above, a portion 109 of the length of the capillary tube 108 is secured to a portion 110 of the length of the suction tube 107, such that conduction of heat can take place between the two tubes and between the fluid in the two tubes. Consequently, heat is conducted from the liquid refrigerant in the capillary tube to the fluid in the suction tube. This has two beneficial effects. Firstly, the heat from the capillary tube received by the suction tube ensures that any residual liquid leaving the evaporator 201 is evaporated before it reaches the compressor 103. Secondly, the loss of heat from the liquid refrigerant in the capillary tube means that it reduces in temperature during its passage to the evaporator. Consequently, the low temperature of the liquid entering the evaporator ensures that the evaporation of liquid takes place along much of the length of the evaporator.

Thus, the suction tube 107 in combination with the capillary tube 108 form a heat exchanger which has beneficial effects on the operation of the refrigeration unit 101.

In alternative embodiments the refrigeration unit 101 is a domestic freezer, or other refrigeration unit which makes use of a heat exchanger for transferring heat from a evaporator inlet tube, such as a capillary tube, to an evaporator outlet (suction) tube.

FIG. 3

Figure 3:
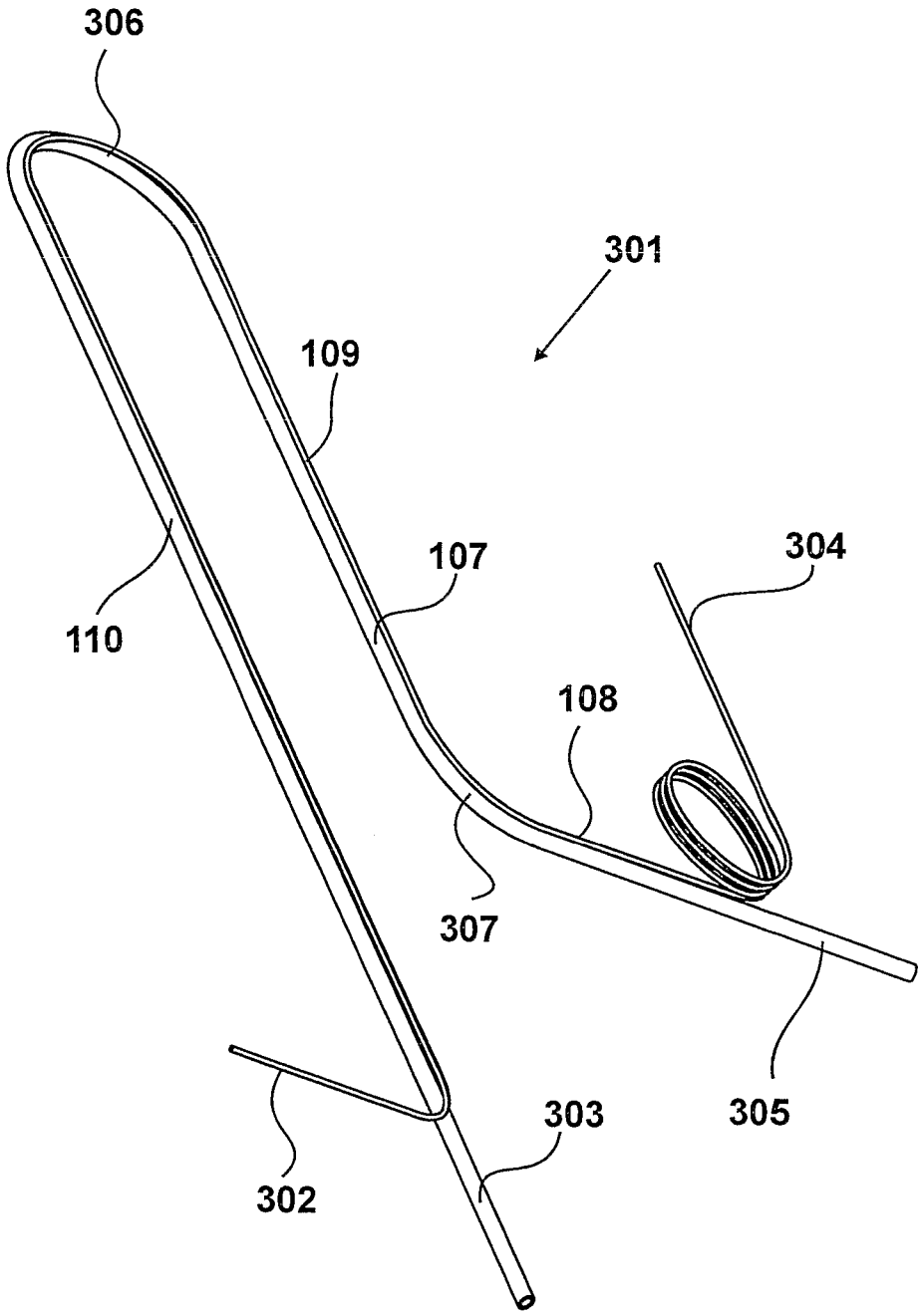
FIG. 3 shows a heat exchanger 301 comprising a suction tube 107 and a capillary tube 108 prior to fitting within the refrigeration unit 101.

A heat exchanger 301 comprising the suction tube 107 and capillary tube 108 is shown in FIG. 3, prior to fitting within the refrigeration unit 101. The heat exchanger 301 is formed as an item in advance of the assembly of the refrigeration unit 101.

Thus, in the present embodiment, the middle portion 110 of the suction tube 107 and the middle portion 109 of the capillary tube 108 are secured together by solder, while a first end portion 302 of the capillary tube remains separate to a first end portion 303 of the suction tube to allow said end portions to be connected to the separate inlet 203 and outlet 204 of the evaporator 201. Similarly, a second end portion 304 of the capillary tube 108 remains separate to a second end portion 305 of the suction tube to allow said second end portions to be connected to the filtering unit 106 and compressor 103 respectively.

In addition, the heat exchanger is bent by machinery prior to the assembly of the refrigeration unit 101, so as to minimise the need for manual bending during assembly. Thus, in the present example, the heat exchanger 301 is provided with a 180 degree bend 306 and a 90 degree bend 307.

FIG. 4

Figure 4:
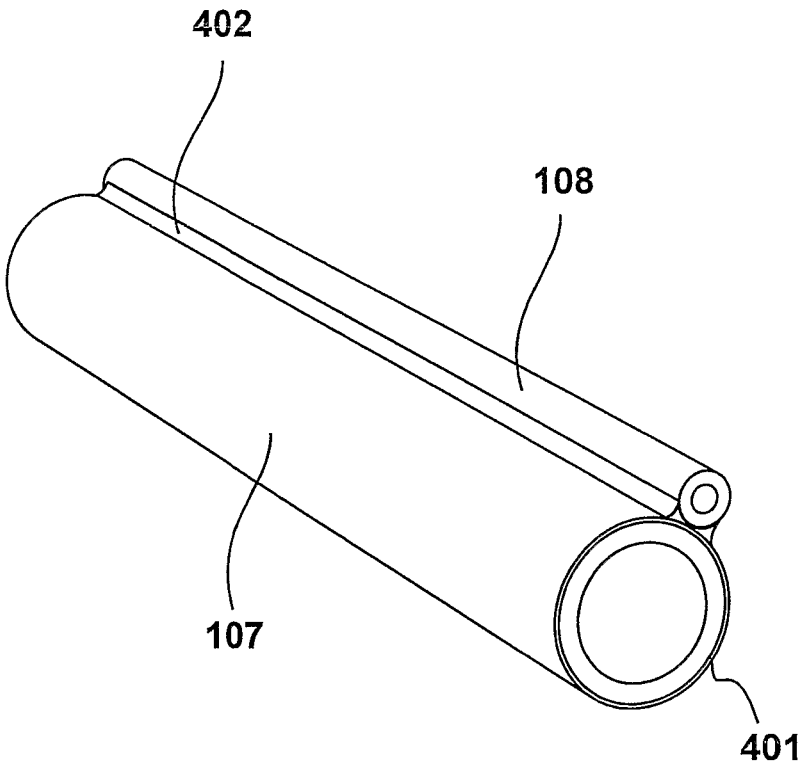
FIG. 4 shows a section of the soldered portions of the suction tube 107 and capillary tube 108.

A section of the soldered portions of the suction tube 107 and capillary tube 108 are shown in FIG. 4. The capillary tube 108 comprises a copper tube having an internal diameter of typically 0.7 millimeters.

The suction tube has a relatively larger internal diameter of typically 4.6 to 6.6 millimeters and has a wall thickness of 0.7 millimeters. The outer surface of the suction tube is coated with a zinc coating 401 during its production and prior to soldering of the two tubes 107 and 108.

The zinc coating 401 provides the steel suction tube 107 with protection against corrosion during use. In addition, zinc coating 401 provides the steel suction tube 107 with a surface that allows the solder to wet the tube in a reliable and repeatable manner. Consequently, a well formed fillet of solder is produced between the two tubes.

The solder 402 is a tin and silver alloy solder having 97% tin and 3% silver. However, in an alternative embodiment, the solder is a tin and copper alloy and the use of other similar solders is envisaged.

In an alternative embodiment the capillary tube is brazed to the suction tube rather than being soldered.

FIG. 5

Figure 5:
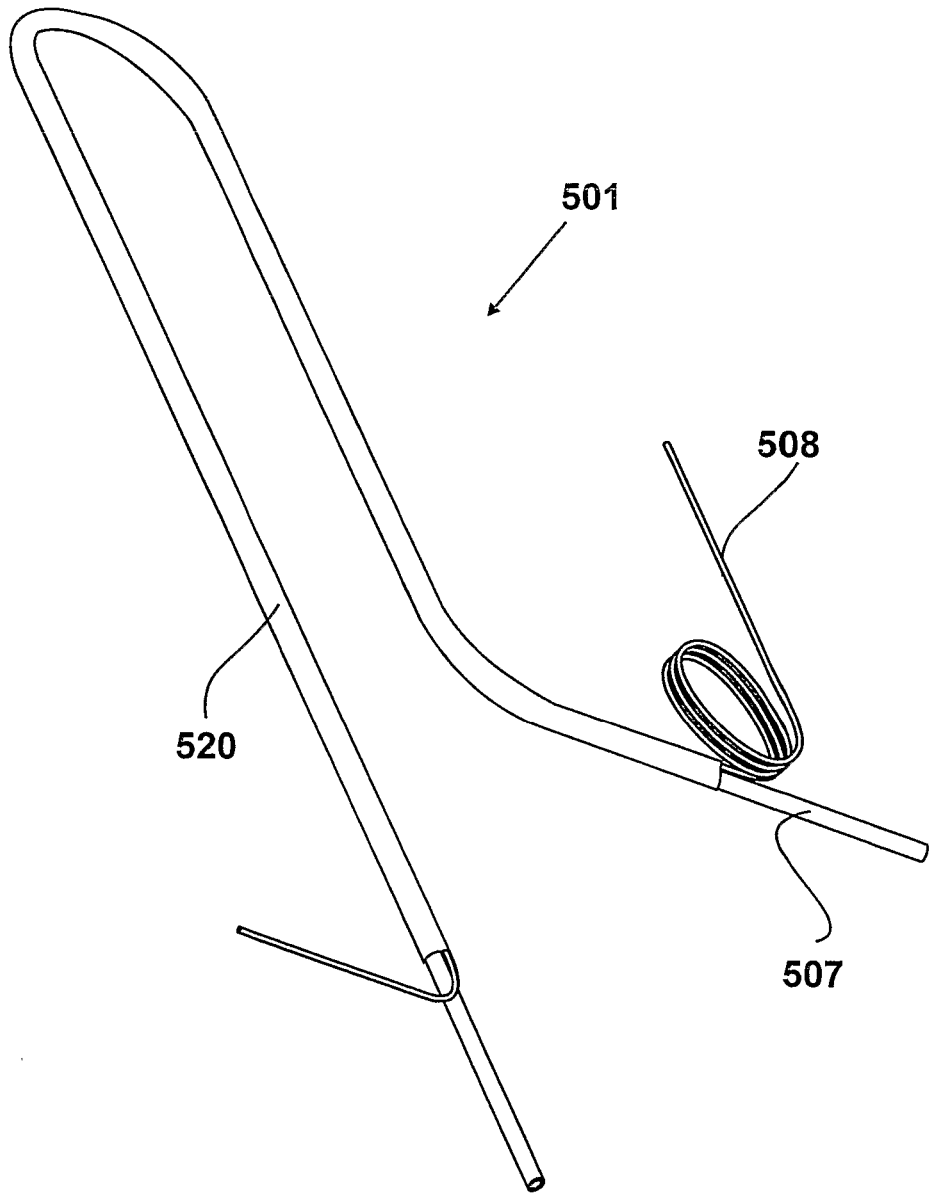
FIG. 5 shows an alternative heat exchanger 501.

An alternative heat exchanger 501 to that of FIG. 3 is shown in FIG. 5. Heat exchanger 501 is of similar construction to heat exchanger 301 in that it has a steel suction tube 507 having an outer surface coated with zinc, and a copper capillary tube 508. However, the capillary tube 508 is secured to the suction tube 507 by an outer sleeve 520 which, in this case, is a heat-shrink material. In the present example the heat shrink comprises of a polyolefin material, but in alternative embodiments other known heat shrink materials, such as polyvinyl chloride (PVC) or polytetrafluoroethylene (PTFE) are used.

FIG. 6

Figure 6:
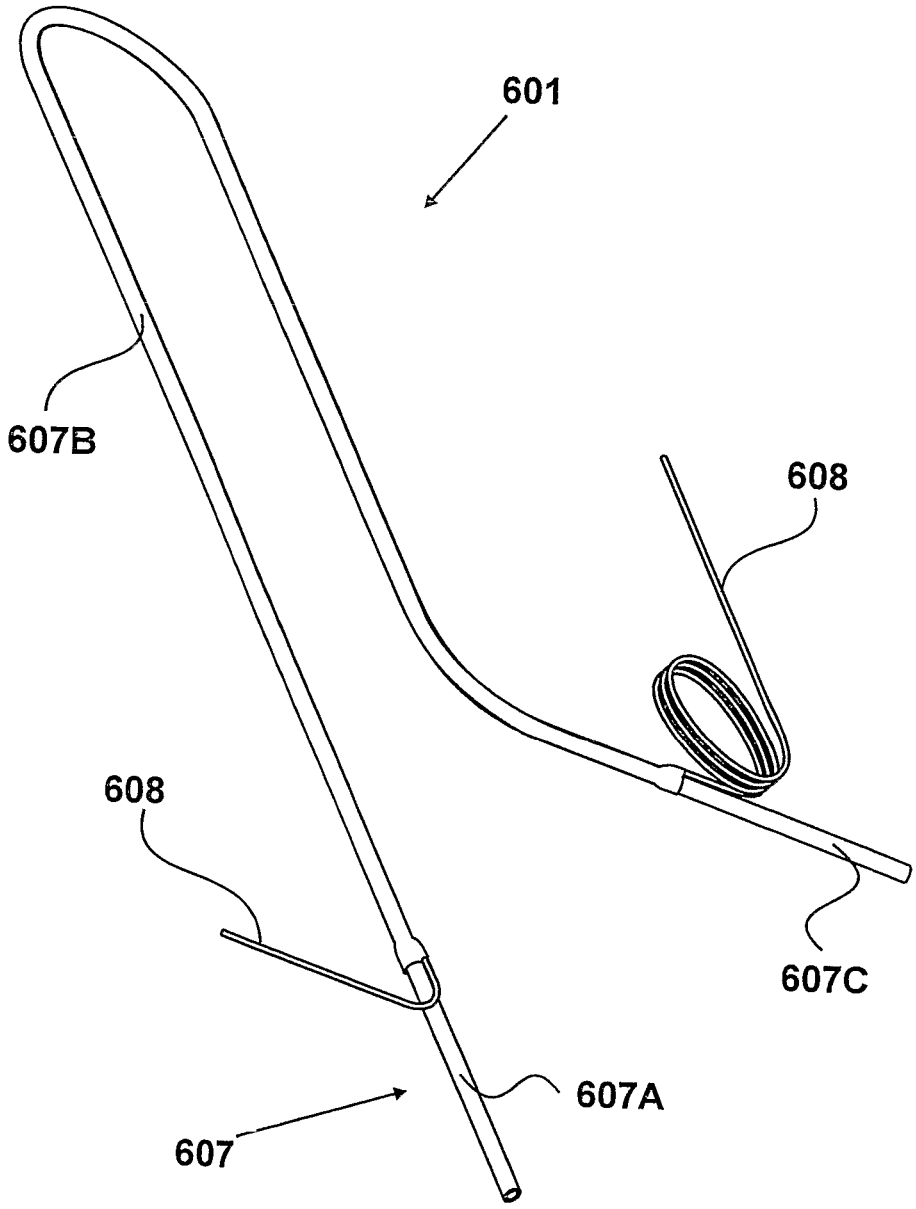
FIG. 6 shows a further alternative heat exchanger 601.

A further alternative heat exchanger 601 is shown in FIG. 6. The heat exchanger 601 has a suction tube 607 formed in three sections 607A, 607B and 607C which are joined together by a solder joint to form a continuous tube. The central section 607B of the suction tube 607 contains a middle portion of the length of a copper capillary tube 608. Consequently, during use, heat is able to leave the liquid refrigerant in the capillary tube, pass through the capillary tube wall and increase the heat in the gas/liquid refrigerant in the suction tube.

FIG. 7

Figure 7:
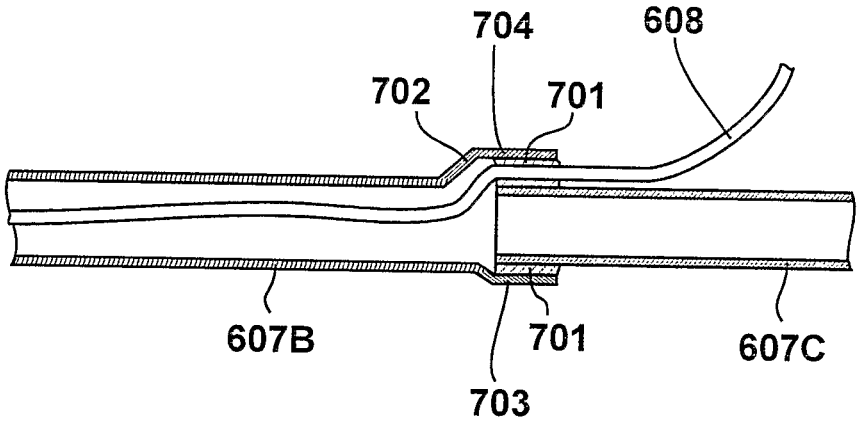
FIG. 7 shows, in cross-section, a portion of the heat exchanger 601 at the solder joint connecting section 607B and section 607C of suction tube 607.

A portion of the heat exchanger 601 at the solder joint connecting section 607B and section 607C of suction tube 607 is shown in cross-section in FIG. 7. The solder joint connecting sections 607A and 607B is similarly configured.

The central section 607B of the suction tube has mechanically deformed end portions 702 produced by expanding said end portions over a mandrel. The end portions of the suction tube are deformed such that the bore has a keyhole-like shape. Thus the end portions have an enlarged cylindrical part 703 configured to receive an end of the outer sections 607A and 607B respectively, and an eccentric part 704 configured to accommodate the capillary tube 608.

Solder 701 mechanically fixes the sections 607B and 607C and capillary tube 608 together and seals around the suction tube and capillary tube to form a leak tight joint. Thus, the solder joints provide a means of allowing the capillary tube to enter and exit the bore of the suction tube.

In an alternative embodiment, the suction tube is formed as a single length and holes are drilled to allow the entry and exit of the capillary tube. The capillary tube is soldered in place where it enters and exits the holes to make the suction tube leak-proof.

FIG. 8

Figure 8:
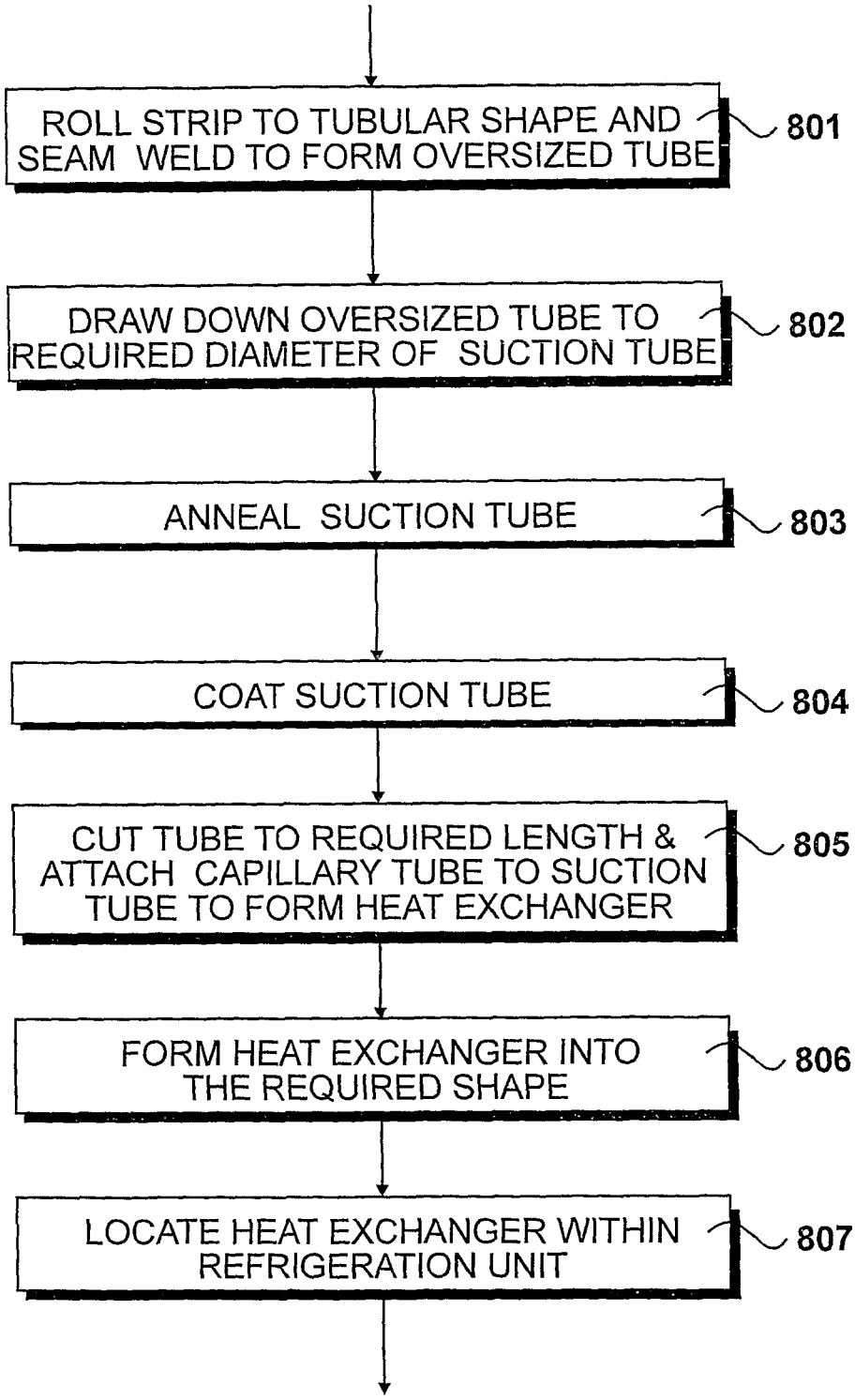
FIG. 8 shows a flow chart of the steps for producing a refrigeration unit containing the heat exchanger of FIG. 3, 5 or 6.

A flow chart showing the steps in producing a refrigeration unit containing an above described heat exchanger is shown in FIG. 8. At step 801 strip metal is formed by a rolling mill into a tubular form and induction welded to close the seam of the tube. The strip used is a low carbon steel strip, with alloyed components as described below.

The tube formed at step 801 has a diameter that is larger than required, and it is drawn down to the required diameter of the suction tube at step 802. For example, a tube of 11 mm diameter may be drawn down to produce an 8 mm diameter suction tube.

At step 803 the tube is annealed to reduce its hardness to facilitate bending. The annealing process at step 803 and the process steps 801 are all performed in-line. Thus, immediately after the formed tube emerges from the rollers of the rolling mill of step 801 it is drawn down to size at step 802 and also annealed at step 803. In a preferred annealing process the tube is heated to a temperature of 480 to 800 degrees centigrade for 5 seconds and maintained at 480 degrees for 15 seconds. However, in practice, an annealing process in which the tube is heated to a temperature of 750 degrees centigrade for 3 seconds, cooled down to 450 degrees centigrade and maintained at 450 degrees for 10 seconds produces a tube which is sufficiently soft to be of practical value. The ease with which this tube may be bent is demonstrated in the bend measurement described below, with reference to FIG. 10.

At step 804 the tube is coated with a corrosion protection layer which protects the steel from corrosion during the suction tube's operational life. In the present example, the coating is a layer of zinc with a weight of at least 70 grams per square metre applied by a hot dip zinc coating process, in accordance with Italian standard UNI 5741-66.

In an alternative embodiment a zinc coating is applied to the outside of the tube at step 804 by electroplating to a thickness of at least 12 micrometers according to international standard ISO 2081, and then yellow passivated in a chrome base electrolyte according to international standard ISO 4520.

In a further alternative embodiment at step 804 the outside of the tube is coated by electroplating aluminium onto it.

Following step 804 the tube is cut to the required length of the suction tube at step 805, and a middle portion of a length of copper capillary tube is attached to a middle portion of the suction tube to form the heat exchanger. In the present example the middle portion of the length of the capillary tube is soldered along the outside of the suction tube using a tin/silver solder comprising 97% tin and 3% silver. However, alternative solders such as tin/copper solder, tin/copper/silver, etc. are envisaged.

In the case of the alternative embodiment FIG. 6, the step 805 of attachment of the capillary tube to the suction tube comprises passing the two tubes through a suitable length of heat shrink sleeve, and then heating the sleeve.

In the case of the alternative embodiment of FIG. 6, the three sections of suction tube are cut to the required lengths, and the ends of the middle section 607B are deformed. The capillary tube is then passed through the middle section and the two end sections positioned and brazed with a silver alloy into the ends of the middle section.

The heat exchanger produced at step 805 is then bent to a required shape at step 806, to produce a formed heat exchanger, such as those shown in FIGS. 3, 5 and 6.

At step 807 the heat exchanger is located within a heat transfer system of a refrigeration unit. This step requires leak proof connections to be made between the suction tube and the capillary tube and a respective end of the evaporator, and then connections between the capillary tube and the filtering and drying unit and between the suction tube and the compressor. During step 807 further manual bending of the heat exchanger is often required, and therefore it is advantageous for the suction tube to be made from a material which is easily bent.

In each of the above described embodiments, the capillary tube is a copper tube. However, in alternative embodiments the capillary tube is an aluminium tube, or other metal capillary tube.

FIG. 9

The suction tube is formed from a low carbon steel, having: a carbon content of less than 0.03% by mass; a manganese content of less than 0.35% by mass; a phosphorus content of less than 0.03% by mass; sulphur content of less than 0.03% by mass; and titanium content of between 0.05 and 0.4%. It may be noted that the steel is not a stainless steel and chromium is not added as an alloy. Thus, only traces of chromium may be found in the composition of the steel.

A table illustrating preferred quantities and typical quantities of alloyed elements of the steel alloy from which the suction tube is made is shown in FIG. 9. In preferred embodiments the carbon content is between 0.001% and 0.02% by mass and typically 0.02% by mass; the manganese content is between 0.10% and 0.25% by mass and typically 0.25% by mass; the phosphorus content is 0.02% by mass, or less, and typically 0.02% by mass; the sulphur content is between 0.01% and 0.02% by mass and typically 0.02% by mass; and the titanium content is between 0.06 and 0.3% and typically 0.3%. This type of steel has a yield strength of 180 $N/mm^2$, a tensile strength of 270-350 $N/mm^2$ and a minimum elongation of 40%. Consequently, it has been found that a suction tube made from such steel may be manually manipulated and bent in a similar manner to a copper suction tube.

In preferred embodiments of the steel tube, the steel alloy is such that the titanium content by mass is more than four times that of carbon. Furthermore, it is preferable that the titanium content by mass is more than the sum total of four times the mass of carbon, 3.42 times the mass of nitrogen and 1.5 times the mass of sulphur. I.e. percent mass of titanium is greater than 4×(percentage mass of carbon)+3.42×(percentage mass of nitrogen)+1.5×(percentage mass of sulphur). Consequently, the titanium forms compounds with the carbon, nitrogen and sulphur, but a small excess of free titanium is left in the alloy.

The relatively high level of titanium and low level of carbon within the alloy ensures that the carbon is present in the form of titanium carbide. Locking the carbon up in this way, gives a steel with substantially no ageing effect. Thus, this makes manual bending of the tube easy, even when the tube is many months old.

Ease of bending is a requirement during installation of the heat exchanger within a refrigeration unit, and therefore the lack of ageing of the steel tube allows the tube and/or the complete heat exchanger to be stored for many months before installation of the heat exchanger.

FIG. 10

In an experiment to illustrate the suitability of the annealed low carbon suction tube for use in the heat exchanger, a typical length of 6 mm diameter copper tube was secured at one end between a pair of jaws and the opposing end was pulled using a scale to measure the force applied. This was repeated for a similar lengths of a conventional steel tube, made from steel strip according to EN10139 ed. 1999, and the annealed low carbon steel tube, used in the heat exchanger of FIG. 3.

The parameters of the tubes and relative bending torque required to cause the tubes to plastically bend are shown in the table of FIG. 10. As demonstrated, the copper tube was the easiest to bend but the annealed low carbon steel tube was substantially softer than the conventional steel tube.

Previously, the relative rigidity of the conventional steel tube often meant that a copper suction tube must be used. However, the workability of the annealed low carbon steel tube facilitates the bending and positioning of the heat exchanger within refrigeration units, such as unit 101.

The invention claimed is:

1. A heat transfer system comprising working fluid that undergoes compression and evaporation, an evaporator having an inlet and an outlet, and a heat exchanger, said heat exchanger comprising: a first tube having a first end connected to said outlet of the evaporator to allow transmission of said working fluid from said outlet; and, a second tube having a first end connected to said inlet of the evaporator to allow transmission of said working fluid to said inlet, wherein a portion of the length of the first tube is positioned in thermal contact with a portion of the length of the second tube so as to allow an exchange of heat between the working fluid in said first tube and the working fluid in said second tube; said first tube is constructed from a steel alloy having a carbon content of less than 0.03% by mass and a titanium content of between 0.05% and 0.4% by mass, thereby reducing the hardness of the steel alloy to facilitate bending of the first tube during installation within the heat transfer system.

2. The heat transfer system according to claim 1, wherein said first end of said first tube and said first end of said second tube extend separately from each other to allow respective connections to said outlet and said inlet of said evaporator.

3. The heat transfer system according to claim 1, wherein the second tube is a capillary tube for transmission of fluid to the evaporator.

4. The heat transfer system according to claim 3, wherein said second tube comprises a capillary tube for transporting liquid to the evaporator of the heat transfer system, and said first tube comprises a suction tube for transporting fluid from the evaporator, wherein a portion of said length of the capillary tube is secured to a portion of the length of said suction tube such that thermal conduction is provided from the liquid in said capillary tube to the fluid in said suction tube, and, wherein said suction tube comprises a steel alloy tube, and at least said portion of said suction tube is coated with a protective coating providing a surface onto which said capillary tube is soldered or brazed.

5. The heat transfer system according to claim 4, wherein said protective coating comprises zinc.

6. The heat transfer system according to claim 4, wherein said protective coating on said suction tube is produced by hot dip zinc coating.

7. The heat transfer system according to claim 4, wherein said capillary tube is a copper tube.

8. The heat transfer system according to claim 1, wherein the steel alloy of said first tube has a titanium content between 0.06% and 0.3% by mass.

9. The heat transfer system according to claim 1, wherein the steel alloy of said first tube has a percentage titanium content by mass which is greater than four times the percentage carbon content by mass of the steel alloy.

10. The heat transfer system according to claim 1, wherein said first tube comprises steel having a manganese content of less than 0.35% by mass, a phosphorus content of less than 0.03% by mass, and a sulphur content of less than 0.03% by mass.

11. The heat transfer system according to claim 10, wherein said first tube comprises steel having a carbon content of up to 0.02% by mass, a manganese content of up to 0.25% by mass, a phosphorus content of up to 0.02% by mass and a sulphur content of up to 0.02% by mass.

12. The heat transfer system according to claim 1, wherein said first tube has a seam weld.

13. The heat transfer system according to claim 1, wherein said first tube has a protective metallic coating which resists corrosion of the steel alloy.

14. The heat transfer system according to claim 13, wherein said first tube is aluminium plated.

15. The heat exchanger according to claim 13, wherein said first tube has a zinc coating.

16. The heat transfer system according to claim 13, wherein said heat exchanger further comprises solder or braze and said portion of the length of the second tube is attached to the protective coating of the first tube by said solder or braze.

17. The heat transfer system according to claim 1, wherein said heat exchanger further comprises solder or braze attaching the second tube to the first tube.

18. The heat transfer system according to claim 17, wherein the second tube is attached to the first tube using solder comprising of tin alloy.

19. The heat exchanger according to claim 1, wherein the second tube is attached to the first tube using a heat shrinkable tube.

20. The heat exchanger according to claim 1, wherein said portion of the length of the second tube is located within the bore of the first tube.

21. The heat transfer system according to claim 1, wherein said steel alloy is in an annealed state in order to further reduce its hardness.

* * * * *

UNITED STATES PATENT AND TRADEMARK OFFICE

CERTIFICATE OF CORRECTION

PATENT NO. : 8,567,485 B2
APPLICATION NO. : 11/575930
DATED : October 29, 2013
INVENTOR(S) : Bengt Ake Viklund et al.

It is certified that error appears in the above-identified patent and that said Letters Patent is hereby corrected as shown below:

On the title page, please correct the following:

Item (73) Assignee should read:
Bundy Refrigeration International Holding B.V., Rotterdam (NL)

Signed and Sealed this
Seventeenth Day of March, 2015

Michelle K. Lee

Michelle K. Lee
*Director of the United States Patent and Trademark Office*